US005642693A

United States Patent [19]

Kotani

[11] Patent Number: 5,642,693

[45] Date of Patent: Jul. 1, 1997

[54] ROCKER ARM AND METHOD OF MANUFACTURING SAME

[75] Inventor: Kazuyuki Kotani, Osaka, Japan

[73] Assignee: Koyo Seiko Co., Ltd., Osaka, Japan

[21] Appl. No.: 621,706

[22] Filed: Mar. 26, 1996

Related U.S. Application Data

[63] Continuation of Ser. No. 271,778, Jul. 7, 1994, abandoned.

[30] Foreign Application Priority Data

Jul. 7, 1993 [JP] Japan ..... 5-167791

[51] Int. Cl.[6] ..... F01L 1/18

[52] U.S. Cl. ..... 123/90.41; 123/90.42; 123/90.43; 123/90.44; 74/559

[58] Field of Search ..... 123/90.39, 90.4, 123/90.41, 90.42, 90.43, 90.44, 90.45, 90.46, 90.47; 74/519, 559

[56] References Cited

U.S. PATENT DOCUMENTS

| | | | |
|---|---|---|---|
| 3,096,749 | 7/1963 | Davidson | 123/90.39 |
| 3,222,950 | 12/1965 | Winter, Jr. | 123/90.39 |
| 4,346,678 | 8/1982 | Wherry | 123/90.44 |
| 4,697,473 | 10/1987 | Patel | 123/90.39 |
| 4,825,717 | 5/1989 | Mills | 123/90.39 |
| 5,010,857 | 4/1991 | Hempelmann et al. | 123/90.39 |
| 5,016,582 | 5/1991 | Mills | 123/90.39 |
| 5,048,475 | 9/1991 | Mills | 123/90.39 |

FOREIGN PATENT DOCUMENTS

| | | | |
|---|---|---|---|
| 573674 | 12/1993 | European Pat. Off. | 123/90.39 |
| 179907 | 7/1993 | Japan | 123/90.39 |
| 108809 | 4/1994 | Japan | 123/90.39 |

*Primary Examiner*—Weilun Lo
*Attorney, Agent, or Firm*—Reid & Priest

[57] ABSTRACT

The invention relates to a rocker arm including a roller, a pair of side walls for supporting the roller, a pivot engaging portion and a valve engaging portion, in which the configuration of the valve engaging portion, and the relative position of the roller, the pivot engaging portion, and the valve engaging portion are set with high accuracy. In the rocker arm, the roller, while being in contact with a cam, is rotatably provided between a pair of side walls forming a rocker arm body. The rocker arm body is of a two-piece structure including a first piece which includes: the pair of side walls adapted to support the roller; and a valve-engaging portion through which, as viewed longitudinally of the rocker arm body, first end portions of the side walls merge with each other; and a second piece which is a pivot engaging member fixedly secured to the remaining second end portions of the side walls.

18 Claims, 8 Drawing Sheets

ROCKER ARM AND METHOD OF MANUFACTURING SAME

This is a continuation of patent application No. 08/271,778, filed Jul. 7, 1994.

BACKGROUND OF THE INVENTION

This invention relates to a rocker arm manufactured by pressing which is rocked by a cam to open and close the valve of a cylinder head (hereinafter referred to merely as "a rocker arm", when applicable), and a method of manufacturing the rocker arm, and more particularly to an improvement for the rocker arm such that a rocker arm body has so-called "two-piece structure".

A rocker arm of so-called "one-piece structure" is known in the art in which three parts, namely, roller supporting side walls, a pivot engaging portion, and a valve engaging portion are formed as one unit by using one piece of metal plate, as disclosed by U.S. Pat. No. 5,016,582.

The known rocker arm is formed as follows: First, one piece of metal plate is blanked to obtain a base material which is substantially rectangular and has an opening at the center. The base material is bent and drawn on the press, to form the desired rocker arm. The valve engaging portion of the rocker arm is curved distinctively. Hence, it is difficult to shape the valve engaging portion as required, and even if the valve engaging portions are formed, they are not uniform in configuration. Therefore, there has been proposed a rocker arm having a so-called "two-piece structure" in which the valve engaging portion is separated from the remaining parts.

The term "two-piece structure" as used herein is intended to means the structure which includes: a first piece comprising the roller supposing side walls and the pivot engaging portion; and a second piece which is the valve engaging portion.

The rocker arm having a "two-piece" structure has, however, the following disadvantages: In joining the second piece, namely the valve engaging portion, to the first piece, there is considerable difficulty in determining the position of the valve engaging portion. Hence, when the rocker arms are manufactured, they are not uniform with respect to the relative positions of the roller, the pivot engaging portion, and the valve engaging portion. The two piece rocker arms have a low manufacturing yield because the valve engaging portion, being distinctively curved, has no flat portion at all, and in joining the valve engaging portion to the first piece, it is difficult to obtain a reference point for positioning the valve engaging portion. Likewise, the pivot engaging portions of one piece rocker arms are very difficult to form since the side walls are integral with both the pivot engaging portion and the valve engaging portion. Side walls on the one piece rocker arms restrict cold forming operations on both the pivot engaging portion and the valve engaging portion.

These limitations on existing one piece rocker arms become particularly significant when attempting to form a rocker arm for use with an overhead cam engine having inclined lifter posts. The continuous structure of the side walls to the pivot engagement portion makes it very difficult to cold form the pivot engagement portion or the semispherical cavity of the pivot engagement portion to an incline as required for engagement with an inclined lifter post. The side walls restrict such a cold forming operation on the pivot engagement portion, and furthermore, such a cold forming operation on a one piece rocker arm would adversely affect the accuracy of the position of the portion of the rocker arm that engages with the valve stem in relation to the cam engaging roller. An additional disadvantage of cold forming a pivot engagement portion of the rocker arm that is integral with the rest of the rocker arm as disclosed by Mills, is that any finishing work such as grinding of the semispherical cavity of the pivot engagement portion must be carried out while the rocker arm main body together with the pivot engagement portion are held stationary in a special holding jig.

SUMMARY OF THE INVENTION

In view of the foregoing, an object of this invention is to provide a rocker arm comprising a roller, a pair of side walls for supporting the roller, a pivot engaging portion and a valve engaging portion in which the configuration of the valve engaging portion, and the relative position of the roller, the pivot engaging portion, and the valve engaging portion are set with high accuracy; and a method of manufacturing the rocker arm.

The foregoing object and other objects of the invention have been achieved by the following means:

The first means is a rocker arm in which a roller, with which a cam is slidably in contact, is rotatably provided in a rocker arm body at the middle as viewed in the longitudinal direction thereof; in which the rocker arm body is of a two-piece structure including:

a first piece which comprises a pair of side walls for supporting the roller, which are confronted substantially in parallel with each other, and a connecting portion through which, as viewed longitudinally of the rocker arm body, first end portions of the side walls merge with each other and which is formed with a curved valve-engaging portion; and a second piece which is a pivot engaging member fixedly secured to the remaining second end portions of the side walls, and the pivot engaging member being a flat plate having a semi-spherical portion formed by drawing.

The second means is a rocker arm adapted to be driven by a cam, the rocker arm comprising:

a one-piece main body including a pair of integral side walls extending parallel to each other and defining a longitude, and an integral connecting portion connecting the side walls to each other at a first end with respect to the longitude; and a pivot engageable plate separated from the main body and adapted to be fixed on the side walls at a second end opposite from the first end with respect to the longitude, the pivot engageable plate having a planer part and a semi-spherical part circumscribed by the planer part.

The third means is a method of manufacturing a rocker arm comprising the steps of:

blanking a piece of plate to obtain a base material for forming a rocker arm body, the base material being substantially U-shaped in a plan view having two protrusions which are substantially in parallel with each other;

bending the base material until the two protrusions are confronted substantially in parallel with each other, to provide a pair of side walls having a coupling portion between the side walls;

curving the coupling portion between the side walls, to provide a valve engaging portion; and fixedly securing to the free end portions of the side walls a pivot engaging member which is a flat plate having a semi-spherical portion formed by drawing.

In the rocker arm, the rocker arm body is of a so-called "two-piece structure" including the first piece which comprises the roller supporting side walls and the valve engaging portion, and the second piece which is the pivot engaging member provided separately from the first piece. Before the second piece, namely, the pivot engaging portion is joined to the first piece comprising the roller supporting side walls and the valve engaging portion, the first piece is substantially U-shaped in a plan view; that is, it is not annular. Hence, the valve engaging portion, which is distinctively curved, can be relatively readily formed.

The pivot engaging member is the flat plate having the semi-spherical portion corresponding in configuration to the pivot. The flat surface of the flat plate and the top of the semi-spherical portion can be utilized as reference points for positioning the pivot engaging member in joining the latter to the first piece of the rocker arm body. That is, in positioning the pivot engaging member, the reference points can be readily obtained.

The provision of the pivot engaging portion as a separate piece from the rest of the rocker arm allows finishing work to be carried out on the pivot engaging portion before it is welded to the rocker arm body. Hence, the final dimensions of the pivot engaging portion, as well as the final dimensions between the pivot engaging portion, the roller, and the valve engaging portion can be controlled more accurately than with prior rocker arms. The pivot engaging portion can also be welded to the rocker arm body in a position to accommodate an inclined lifter post without detrimentally affecting the accuracy of such final dimensions.

Finally, the provision of a separate pivot engaging portion allows for a reduction in the overall width of the finished rocker arm since the portions of the side walls between which the pivot engaging portion is welded have a rectangular cross section and do not have to be deformed to meet an integral pivot engaging portion as in the prior rocker arms.

DETAILED DESCRIPTION OF THE PREFERRED EMBODIMENTS

Preferred embodiments of the invention will be described with reference to FIGS. 1 through 14.

pressing

An example of a rocker arm formed by (hereinafter referred to merely as "a rocker arm", when applicable), which constitutes a first embodiment of the invention, will be described with reference to FIGS. 1 through 7.

Figure 4:
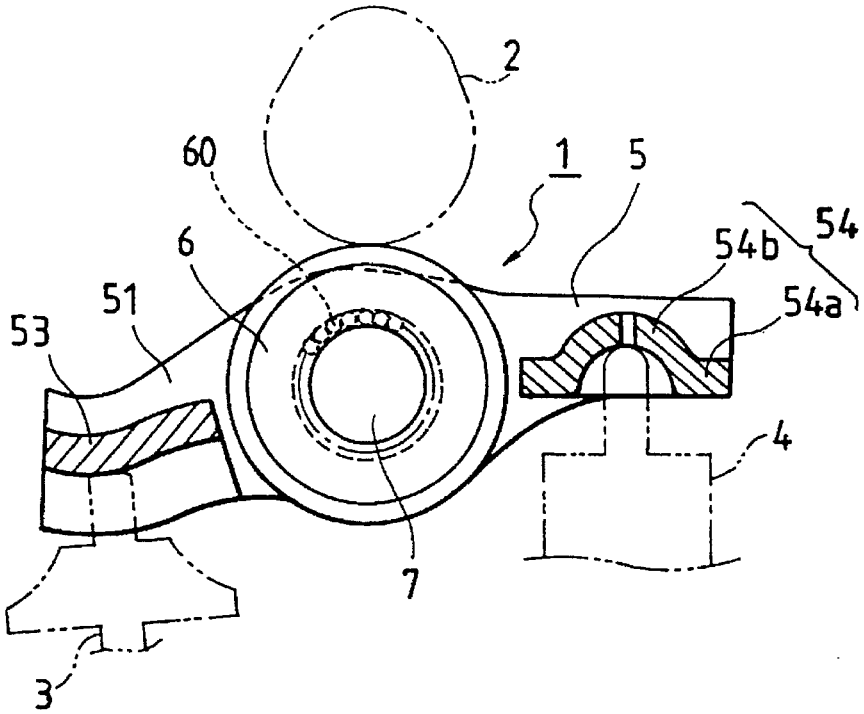
FIG. 4 is a sectional view taken along line (4)—(4) in FIG. 3.
Figure 5:
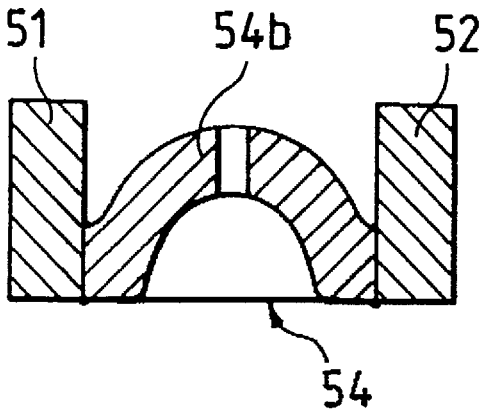
FIG. 5 is a sectional view taken along line (5)—(5) in FIG. 3.

In FIG. 4, showing the rocker arm which is in use, reference numeral 1 designates the rocker arm; 2, the cam of a cam shaft; 3, a valve stem; and 4, the pivot of a lash adjuster.

Figure 1:
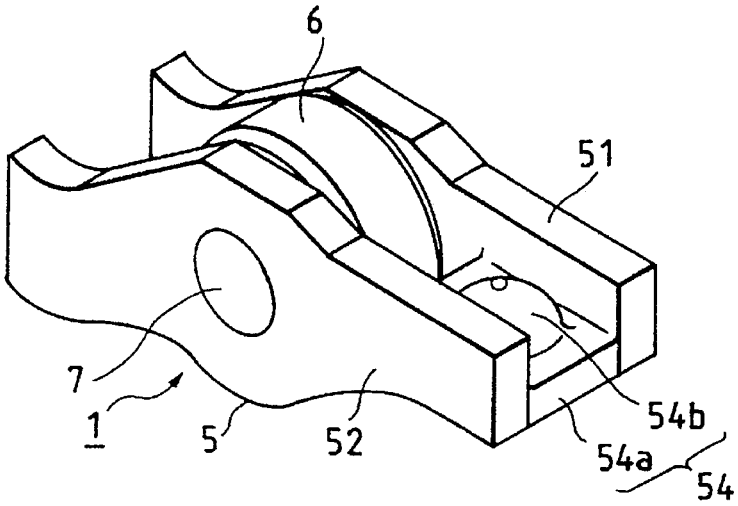
FIG. 1 is a perspective view of one example of a rocker arm, which constitutes a first embodiment of this invention.
Figure 2:
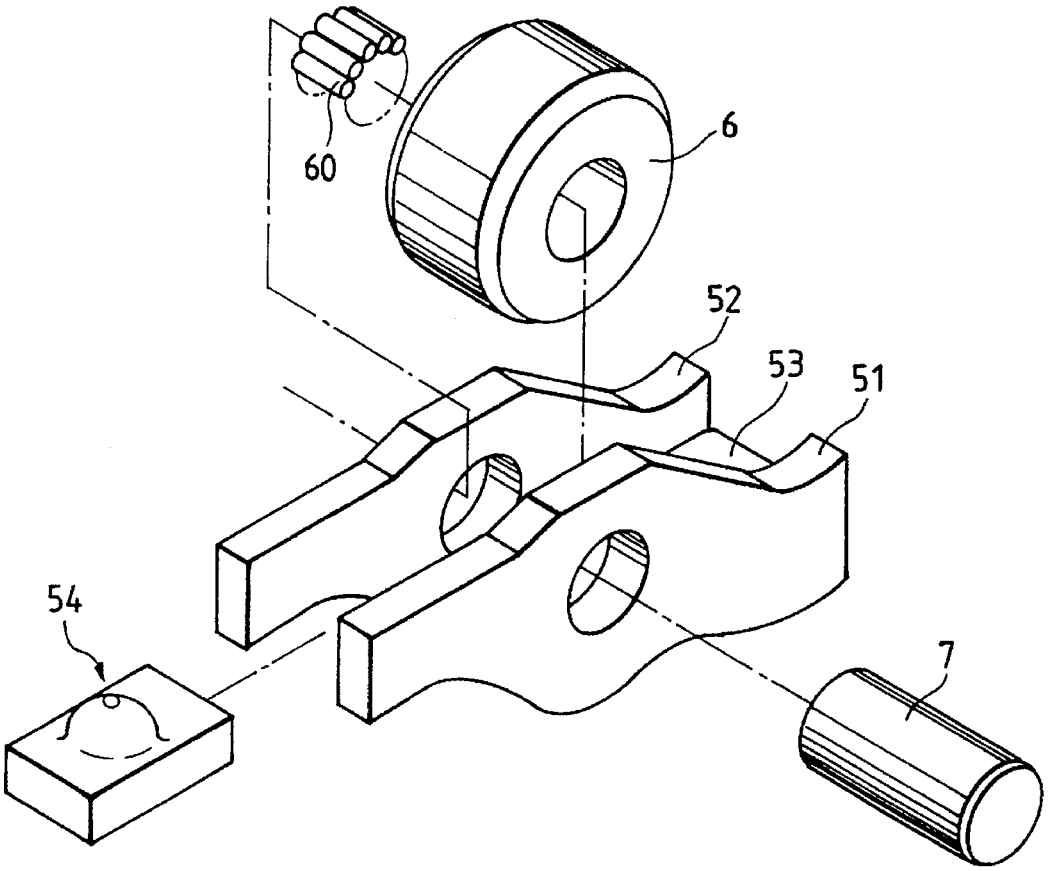
FIG. 2 is an exploded perspective view of the rocker
Figure 6:
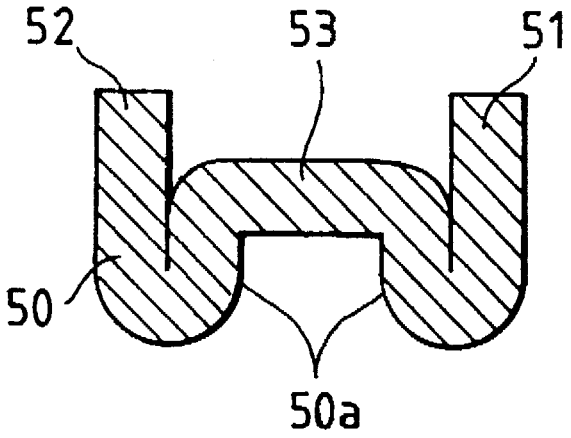
FIG. 6 is a sectional view taken along line (6)—(6) in FIG. 3.
Figure 7A:
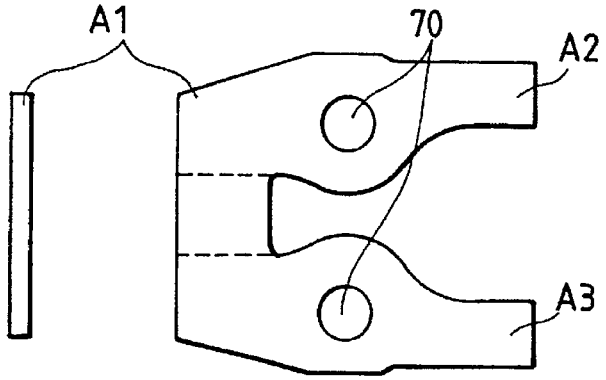
FIGS. 7(*a*), 7(*b*), 7(*c*) and 7(*d*) are diagrams for a description of a process of manufacturing the rocker arm.
Figure 7B:
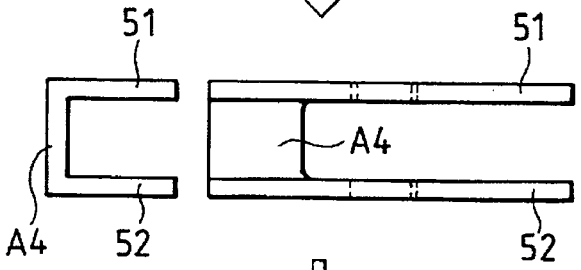
Figure 7C:
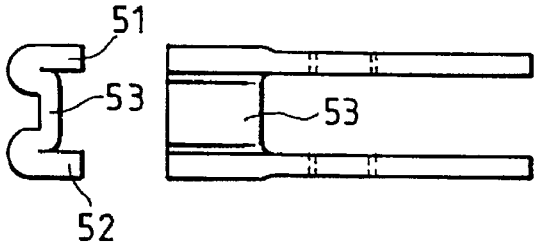
Figure 7D:
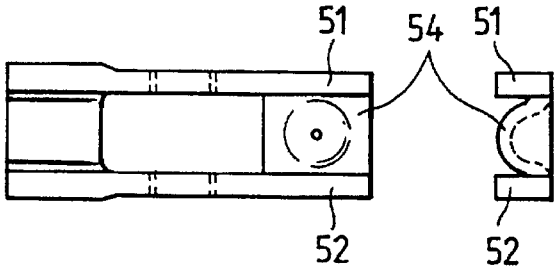
Figure 8:
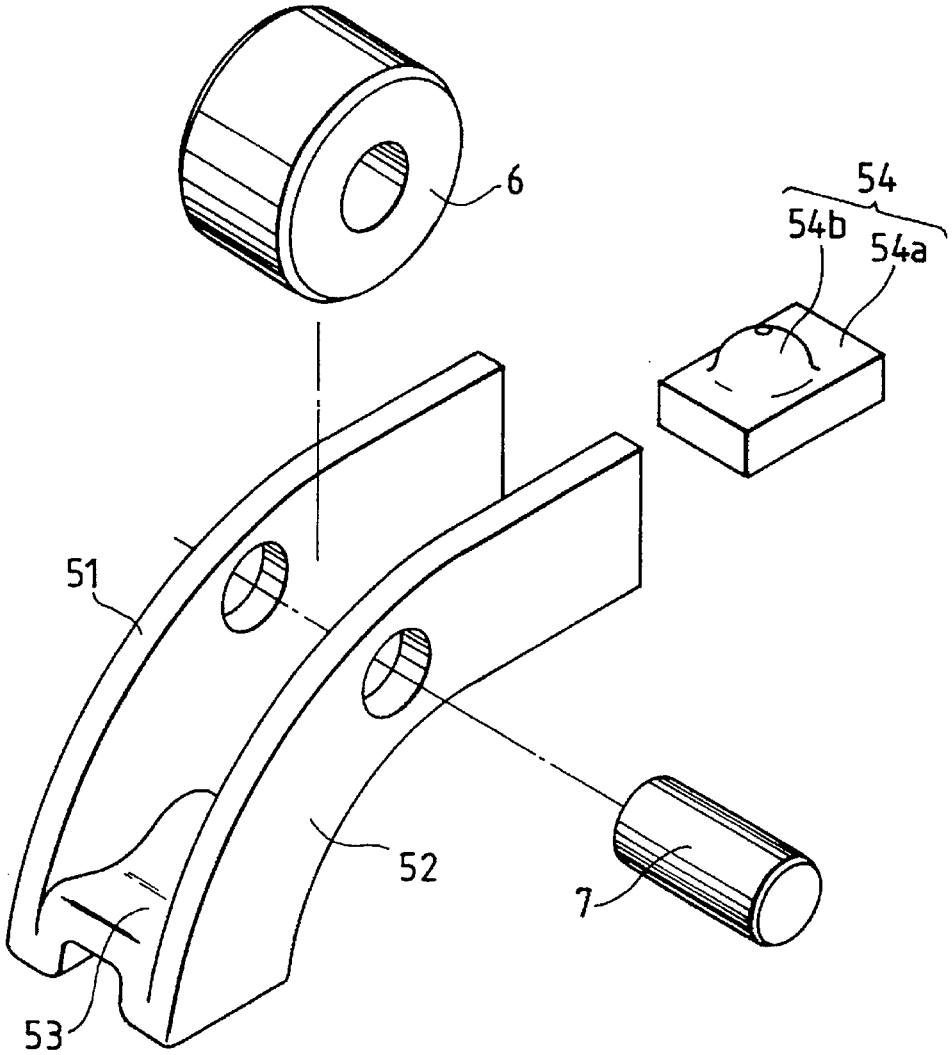
FIG. 8 is an exploded perspective view showing another example of the rocker arm, which constitutes a second embodiment of the invention.
Figure 9:
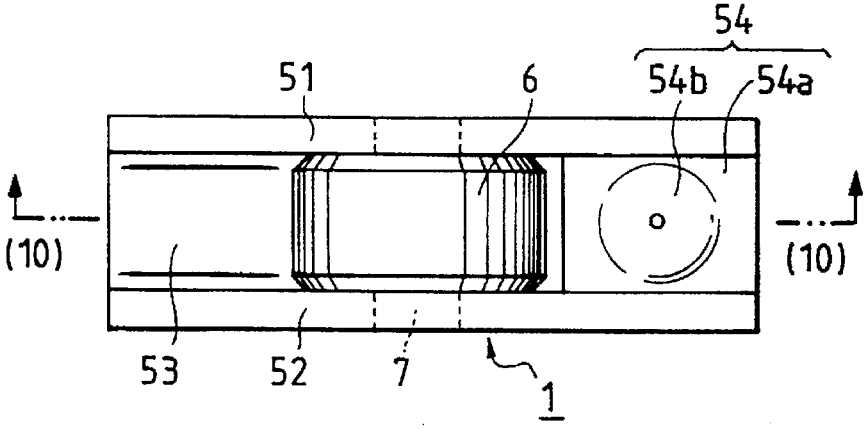
FIG. 9 is a plan view of the rocker arm shown in FIG. 8.
Figure 10:
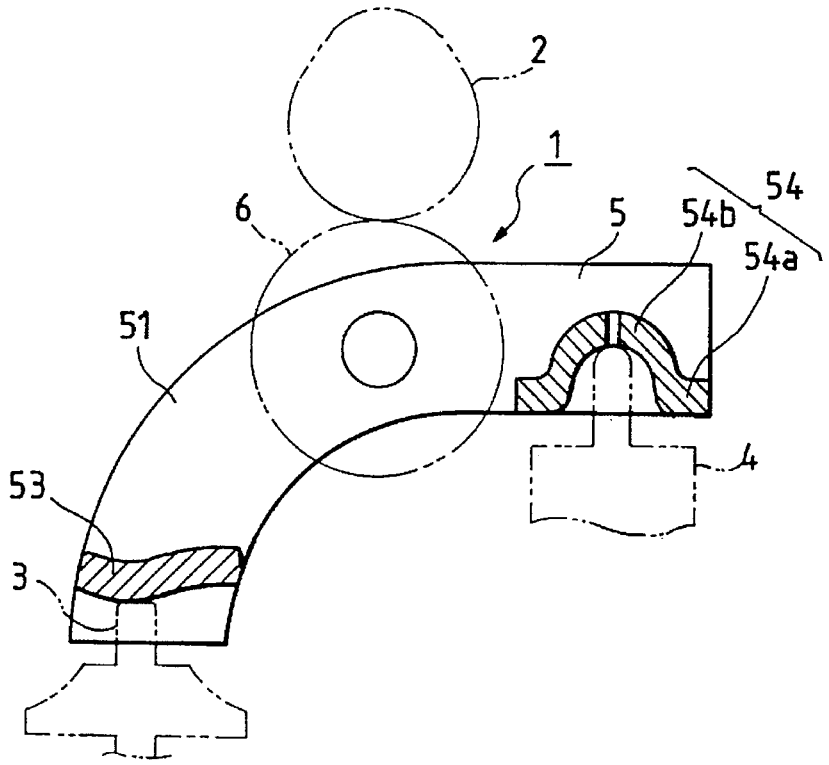
FIG. 10 is a sectional view taken along line (10)—(10) in FIG. 9.

Roughly stated, the rocker arm 1 comprises: a rocker arm body 5; and a roller 6 which is rotatably mounted in the former 5. The rocker arm body 5 is of so-called "two-piece structure"; that is, it, as shown in FIG. 2, consists of: a first piece (component) comprising a pair of right and left side walls 51 and 52 which are extended substantially in parallel with each other, and a connecting or coupling portion having a valve engaging portion 53, through which, as viewed longitudinally of the rocker arm body, first end portions of the right and left side walls 51 and 52 merge with each other; and a second piece (component) which is a pivot engaging member or pivot engageable plate 54 fixedly connected to the remaining second end portions (free end portions) of the right and left side walls 51 and 52. More specifically, the first piece is folded as shown in FIG. 6. That is, the valve engaging portion 53 is folded over the right and left side walls 51 and 52 as indicated at 50, thus forming valve guides 50*a* and 50*a* along the side walls 51 and 52.

The pivot engaging member 54, as shown in FIGS. 2 and 4, is a rectangular metal plate 54*a* having a semi-spherical portion 54*b* at the center which is formed by drawing. The semi-spherical portion 54 is to engage with the head of the pivot 4. The two long sides of the pivot engaging member 54 thus formed are welded to the inner surfaces of the right and left side walls 51 and 52.

Figure 3:
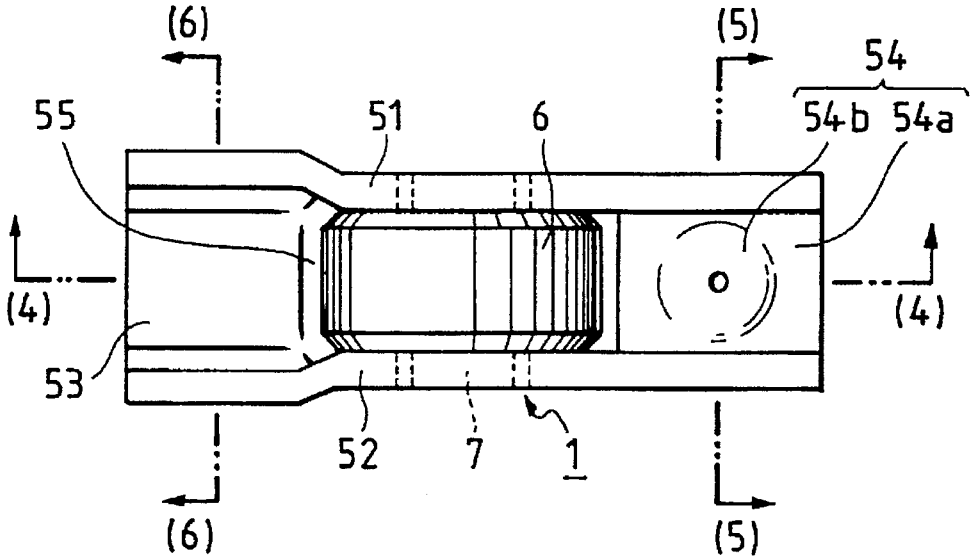
FIG. 3 is a plan view of the rocker arm.

The roller 6 is rotatably mounted on a shaft 7 supported by the right and left side walls 51 and 52; that is, the roller 6, as shown in FIG. 3, is arranged in a rectangular space 55 which is defined by the side walls 51 and 52, the valve engaging portion 53, and the pivot engaging member 54. A bearing 60 is provided between the shaft 7 and the roller 6. Preferably, the shaft 7 is fixedly secured to the side walls 51 and 52 by suitable means, for instance, by caulking axial ends of the shaft 7.

A method of manufacturing the above-described rocker arm will be described with reference to FIGS. 7(*a*) to 7(*d*).

First, as shown in FIG. 7(*a*), a base material A1 for forming the rocker arm body 5 is formed by blanking a piece of metal plate. The base material A1 is substantially U-shaped in a plan view, having two protrusions A2 and A3 which are substantially in parallel with each other. Furthermore, the base material A1 has through-holes 70 and 70, into which the roller supporting shaft 7 is to be inserted. As shown in FIG. 7(*b*), the base material A1 is bent right angles along the broken lines (FIG. 7(*a*)) in such a manner that the protrusions A2 and A3 are confronted in parallel with each other, to form the right and left side walls 51 and 52 having a coupling or connecting portion A4 between them. Thereafter, the portion A4 between the right and left side walls 51 and 52 is folded as shown in FIG. 7(*c*), to form the valve engaging portion 53. Next, as shown in FIG. 7(*d*), the pivot engaging member 54 formed separately is welded to the free end portions of the right and left side walls 51 and 52. Under this condition, the roller 6 is mounted on the right and left side walls 51 and 52 with a bearing 60 through the shaft 7. Thus, the rocker arm has been manufactured. The aforementioned through-holes 70 may be formed in the right and left sides walls 51 and 52 after the latter 51 and 52 have been formed by bending the base material A1 as described above. The curved surface is preferably formed on the valve engaging portion 53 simultaneously at the time of bending the coupling portion A4 to have the inverted-U-shaped transverse section as shown in FIG. 7(*c*), but may be formed thereon after the coupling portion A4 is bent to have the inverted-U-shaped transverse section as shown in FIG. 7(*c*). Also, without bending the coupling portion A4 to have the inverted-U-shaped transverse section as shown in FIG. 7(*c*), the coupling portion A4 may be curved to provide the valve engaging potion 53.

In the above-described first embodiment, in welding the pivot engaging member 54 to the free end portions of the right and left side walls 51 and 52, the reference point for determining the height of the pivot engaging member 54 may be located on the upper surface of the flat portion of the pivot engaging member 54, and the reference point for determining the position of the pivot engaging member 54 in the front-to-rear direction may be located on the top of the semi-spherical portion 54*b* of the pivot engaging member 54. Hence, the position of the pivot engaging member 54 relative to the positions of the roller 6 and the valve engaging portion 53 can be determined with high accuracy.

In addition, the position of the pivot engaging member 54 may be determined as follows: With the lower surface and the side surfaces of the flat portion of the pivot engaging member 54 as references, the guide surface for the head of the pivot 4, defined by the semi-spherical portion 54*b*, is set at a desired position and in a desired direction.

Another example of the rocker arm, which constitutes a second embodiment of the invention, is as shown in FIGS. 8 through 11.

Figure 11:
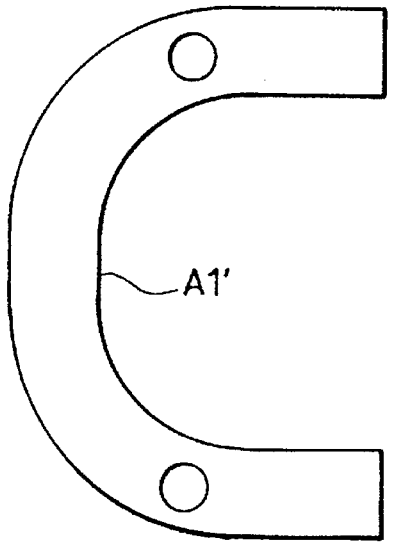
FIG. 11 is a diagram for a description of one manufacturing step in the manufacture of the rocker arm shown in FIG. 9.

In the second embodiment, the right and left side walls 51 and 52 of its rocker arm body 5 are different in configuration from those in the above-described first embodiment. Accordingly, in the second embodiment, the roller 6, the valve engaging portion 53, and the pivot engaging member 54 are different in relative position from those in the first embodiment. The second embodiment is suitable for a valve operating mechanism in which the valve 3 is positioned below the lash adjuster 4. The other arrangements and functions are fundamentally equal to those of the first embodiment. Roughly stated, the rocker arm may be manufactured substantially in the same manner as in the case of the first embodiment; that is, its manufacturing method is differently from the above-described method of the first embodiment only in that a base material A1' for forming the rocker arm body is obtained by blanking a piece of metal plate as shown in FIG. 11.

Figure 12:
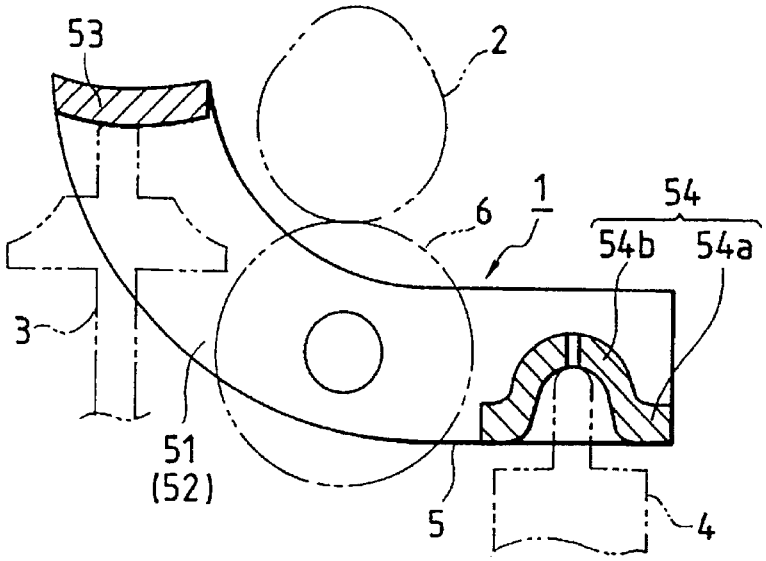
FIG. 12 is a sectional view showing yet another example of the rocker arm, which constitutes a third embodiment of the invention.

In the case of a valve operating mechanism in which the valve 3 is located above the lash adjuster 4, a third embodiment of the invention is applicable thereto, wherein the rocker arm body 5 is so formed that, as shown in FIG. 12, the right and left side walls 51 and 52 are extended downwardly from the valve engaging portion 53. In this case, it is unnecessary to fold the valve engaging portion 53 as indicated at 50 in FIG. 6, and accordingly the valve engaging portion 53 can be formed with high accuracy. In addition, the third embodiment may be modified such that the valve engaging portion 53 is folded to have a substantially U-shaped transverse section.

Figure 16:
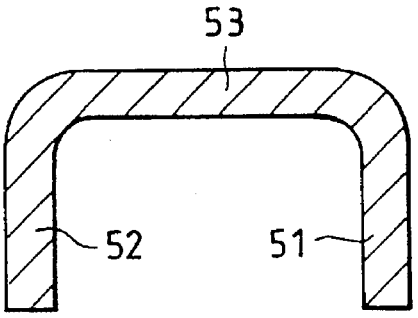
FIG. 16 is a sectional view taken along line (16)—(16) of FIG. 15.
Figure 17:
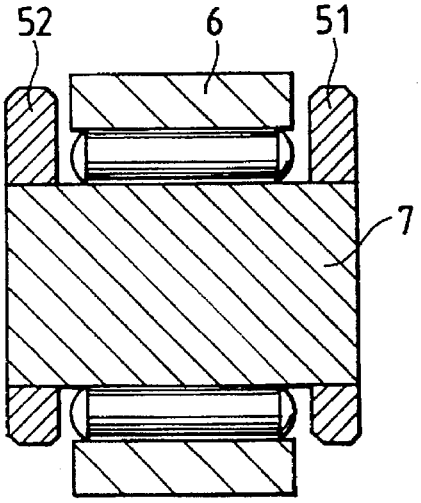
FIG. 17 is a sectional view taken along line (17)—(17) of FIG. 15

FIGS. 14 to 17 show a fourth embodiment which has a configuration similar to that of the first embodiment, but is different from the first embodiment in that the valve engaging portion 53 is located at and connected to the upper end portions of the first end portions of the right and left side walls 51 and 52. The valve engaging portion 53 of this embodiment is not bent as similarly to the third embodiment shown in FIG. 12, so that the combination of the valve engaging portion 53 and the first end portions of the side walls 51 and 52 forms a substantially inverted-U-shaped transverse section as shown in FIG. 16. Further, as shown in FIG. 17, a plurality of needle rolling elements are radially interposed between the inner circumference of the roller 6 and the outer circumference of the shaft 7 to form a bearing means. The shaft 7 is securely fixed to the side walls 51 and 52 by caulking the axial ends of the shaft 7.

Figure 13:
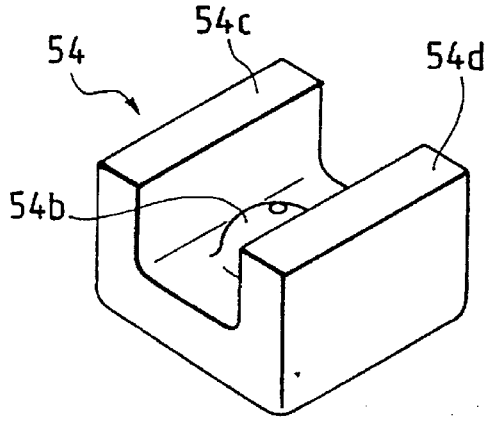
FIG. 13 is a perspective view showing one modification of a pivot engaging member in the rocker arm of the invention.
Figure 14:
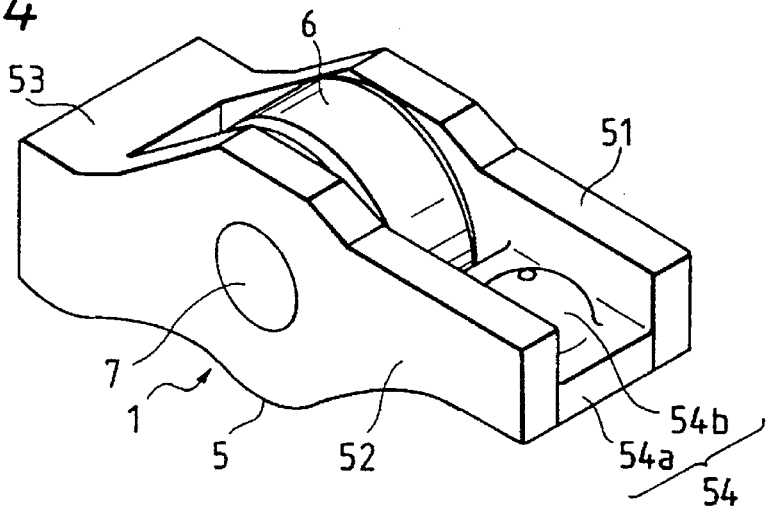
FIG. 14 is a perspective view of still another example of the rocker arm, which constitutes a fourth embodiment of the invention.
Figure 15:
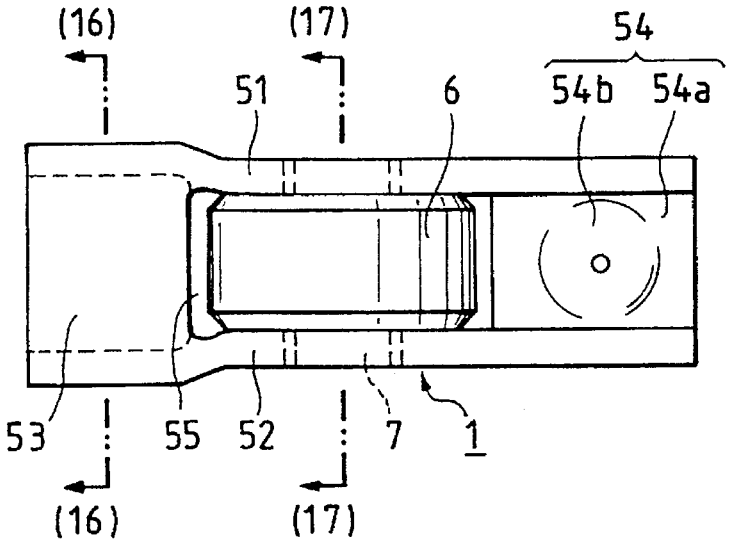
FIG. 15 is a plan view of the rocker arm shown in FIG. 14.

While the first and second embodiments have been described, the invention is not limited thereto or thereby. For instance, the pivot engaging member 54 may be modified as shown in FIG. 13. That is, two side walls 54*c* and 54*d* are formed along the long sides of the flat portion of the pivot engaging member 54, respectively, in such a manner that they are extended upwardly and are confronted in parallel with each other. Alternatively, the side walls 54*c* and 54*d* may be extended downwardly.

In the rocker arm of the invention, the rocker arm body is of so-called "two-piece structure", including the first piece comprising the right and left side walls and the valve engaging portion between those side walls; and the second piece, namely, the pivot engaging member. Hence, the valve engaging portion can be readily formed, and the pivot engaging member can be secured to the first piece of the rocker arm body with ease. The configuration of the valve engaging portion, and the relative position of the roller, the valve engaging portion and the pivot engaging member can be set with high accuracy. Thus, the rocker arm of the invention is high not only in manufacturing yield but also in product reliability.

What is claimed is:

1. A rocker arm in which a roller, with which a cam is slidably in contact, is rotatably provided in a rocker arm body at the middle as viewed in the longitudinal direction thereof, said rocker arm body being of a two-piece structure comprising:

a first piece which comprises a pair of side walls for supporting said roller and a connecting portion, said side walls being arranged substantially in parallel with each other and having first and second end portions, said connecting portion as viewed longitudinally of said rocker arm body, joining said first end portions of said side walls, and said connecting portion being formed with a curved valve-engaging portion; and a second piece which is a pivot engaging member, said pivot engaging member being formed as a separate piece from said first piece and being fixedly secured to said second end portions of said side walls, and said pivot engaging member being a flat plate having a semi-spherical portion formed by drawing.

2. The rocker arm according to claim 1, wherein said valve-engaging portion is formed integrally with said side walls.

3. The rocker arm according to claim 1, wherein said pivot engaging member is fixedly secured to said side walls by welding.

4. The rocker arm according to claim 1, wherein said side walls are respectively formed with through-holes coaxial with each other, and said rocker arm further comprises a shaft inserted into and fixed to said through-holes.

5. The rocker arm according to claim 4, wherein said rocker arm further comprises a plurality of needle rolling elements disposed on an outer circumference of said shaft, and said shaft supports said roller through said plurality of needle rolling elements.

6. The rocker arm according to claim 4, wherein axial ends of said shaft are fixed to said side walls by caulking.

7. The rocker arm according to claim 1, wherein said valve-engaging portion has a substantially U-shaped transverse section.

8. The rocker arm according to claim 1, wherein said pivot engaging member has a substantially U-shaped transverse section.

9. The rocker arm according to claim 1, wherein said valve-engaging portion has a substantially inverted-U-shaped transverse section.

10. A rocker arm adapted to be driven by a cam, said rocker arm comprising:

a main body including a pair of integral side walls and an integral connecting portion, said side walls having first and second ends and extending parallel to each other and defining a longitude, and said connecting portion connecting said side wags to each other at said first end with respect to said longitude, said side walls and said connecting portion being formed in a single piece, and said connecting portion forming a valve-engaging portion; and a pivot engageable plate formed as a separate piece from said main body and adapted to be fixed on said side walls at said second end opposite from said first end with respect to said longitude, said pivot engageable plate having a planar part and a semi-spherical part circumscribed by said planar part.

11. The rocker arm according to claim 10, wherein said connecting portion defines a curved surface.

12. The rocker arm according to claim 10, wherein said pivot engageable plate is fixed to said side walls by welding.

13. The rocker arm according to claim 10, wherein said rocker arm further comprises a roller located between said first and second ends with respect to said longitude, and said side walls rotatably support said roller, said cam being slid on said roller.

14. A rocker arm comprising:

a body including two spaced, parallel side walls having first and second ends and a connecting portion, said first ends of said side walls being connected by said connecting portion such that a section taken through said connecting portion and perpendicular to said side walls is substantially U-shaped, said side walls and said connecting portion being formed as a single piece, and said connecting portion forming a valve-engaging portion; and a pivot engaging member formed as a separate piece from said body, said pivot engaging member being connected between said second ends of said side walls with said second ends of said side walls being substantially rectangular in cross section and said separate pivot engaging member having opposite parallel sides for mating with respective parallel surfaces of said second ends of said side walls.

15. The rocker arm of claim 14, wherein:

said separate pivot engaging member includes a substantially flat lower surface perpendicular to said opposite parallel sides and a concave recess interrupting said substantially flat lower surface between said parallel side walls of said main body.

16. The rocker arm of claim 14, wherein:

said pivot engaging member is secured to said side walls at said second ends of said side walls by weld joints.

17. The rocker arm of claim 14, wherein:

said rocker arm further comprises a shaft being supported by and extending perpendicular to said side walls and being located between said first and second ends of said side walls.

18. The rocker arm of claim 17, wherein:

said rocker arm further comprises a roller in between said side walls, and said shaft rotatably supports said roller.

* * * * *